United States Patent [19]

Ebeling et al.

[11] 3,944,092

[45] Mar. 16, 1976

[54] CONTAINER EMPTYING DEVICE

[76] Inventors: Franklin D. Ebeling; Ernest C. Ebeling, both of 1608 W. 24th St., Plainview, Tex. 79072

[22] Filed: Feb. 3, 1975

[21] Appl. No.: 546,277

Related U.S. Application Data

[63] Continuation of Ser. No. 471,845, May 21, 1974, abandoned.

[52] U.S. Cl. ..... 214/302; 214/651

[51] Int. Cl.[2] ..... B65F 3/02

[58] Field of Search ..... 214/651, 302, 303, 313, 214/315, 730

[56] References Cited

UNITED STATES PATENTS

| | | | |
|---|---|---|---|
| 3,085,702 | 4/1963 | Aldredge et al. | 214/302 |
| 3,278,059 | 10/1966 | Ridgeway et al. | 214/302 |
| 3,520,428 | 7/1970 | Puckett | 214/302 |
| 3,773,197 | 11/1973 | Blakeley et al. | 214/302 |

*Primary Examiner*—Robert J. Spar
*Assistant Examiner*—Lawrence J. Oresky
*Attorney, Agent, or Firm*—Wayland D. Keith

[57] ABSTRACT

An interchangeable side loader unit on a vehicle moves outwardly from the vehicle to a position adjacent support abutment means on a trash and/or refuse container to move open-throat portions of U-shaped members upwardly into engagement with support abutment means, elevates container, automatically blocks open-throat portions of the U-shaped members to prevent disengagement of support abutment means when container reaches the arcuate turn at the top, inverts container to a dumping position, dumps container, moves container to an upright position, lowers container, moves container outwardly to the original position thereof.

6 Claims, 10 Drawing Figures

CONTAINER EMPTYING DEVICE

This is a continuation of application Ser. No. 471,845 filed May 21, 1974 now abandoned.

BACKGROUND OF THE INVENTION

This application is co-pending with our application Ser. No. 410,405, filed Oct. 29, 1973 for MECHANICALLY ACTUATED LOADING ARRANGEMENT FOR A VEHICLE BODY. The background of the invention will be set forth in two parts.

FIELD OF THE INVENTION

The present invention pertains generally to the field of container emptying devices and more particularly to a new and useful device for emptying the contents of a trash and/or refuse container into an elevated access opening in a vehicle body.

DESCRIPTION OF THE PRIOR ART

The prior art known to applicants is listed by way of illustration, but not of limitation, in separate communications to the United States Patent Office.

The present invention exemplifies improvements over this prior art.

OBJECTS AND SUMMARY OF THE INVENTION

It is the primary object of the present invention to provide a new and useful container emptying device, operable by one man, the operator of the vehicle of the type described.

Another object of the invention is to provide an interchangeable container emptying device which may be easily and speedily attached to an elevatior device on a vehicle and which includes a new and useful locking mechanism for automatically locking a container to the container emptying device when the container is tipped to a dumping position adjacent an elevated access opening in the body of the vehicle.

According to the present invention, a new and useful apparatus for emptying the contents of trash and/or refuse containers into a vehicle through an elevated access opening in the vehicle body, is provided. The apparatus may be used in combination with a vehicle having power supply means to empty trash and/or refuse containers.

The apparatus includes elevator means for raising and lowering the container. The elevator means includes an upper end adjacent the elevated access opening and a lower end adjacent a surface supporting the containers.

The apparatus also includes means connecting the elevator means to the power supply means for moving at least the lower end of the elevator means over the surface between a first position closely adjacent the vehicle and a second position spaced laterally outwardly from the vehicle and closely adjacent the container.

A container engaging means is connected to the elevator means for mechanically engaging support abutment means on the container, when the elevator means is moved to the second position by the power supply means. The support abutment means on the container may be engaged by the open-throat portions of U-shaped members provided on the container engaging means.

The apparatus also includes locking means for automatically locking the support abutment means to the container engaging means so that the container will remain in connected relationship with the container engaging means when it is inverted adjacent the elevated access opening to empty the container. The locking means is swingably connected to the container-engaging means by suitable shaft means and includes lock bar means for bridging the open-throat portions of the U-shaped members. The locking means also includes bumper means engageable by the container for swinging the locking means about the shaft means upon movement of the container to the inverted position, so that the lock bar means will move to the bridging position.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which like reference characters refer to like elements in the several views.

DESCRIPTION OF THE PREFERRED EMBODIMENT

Figure 1:
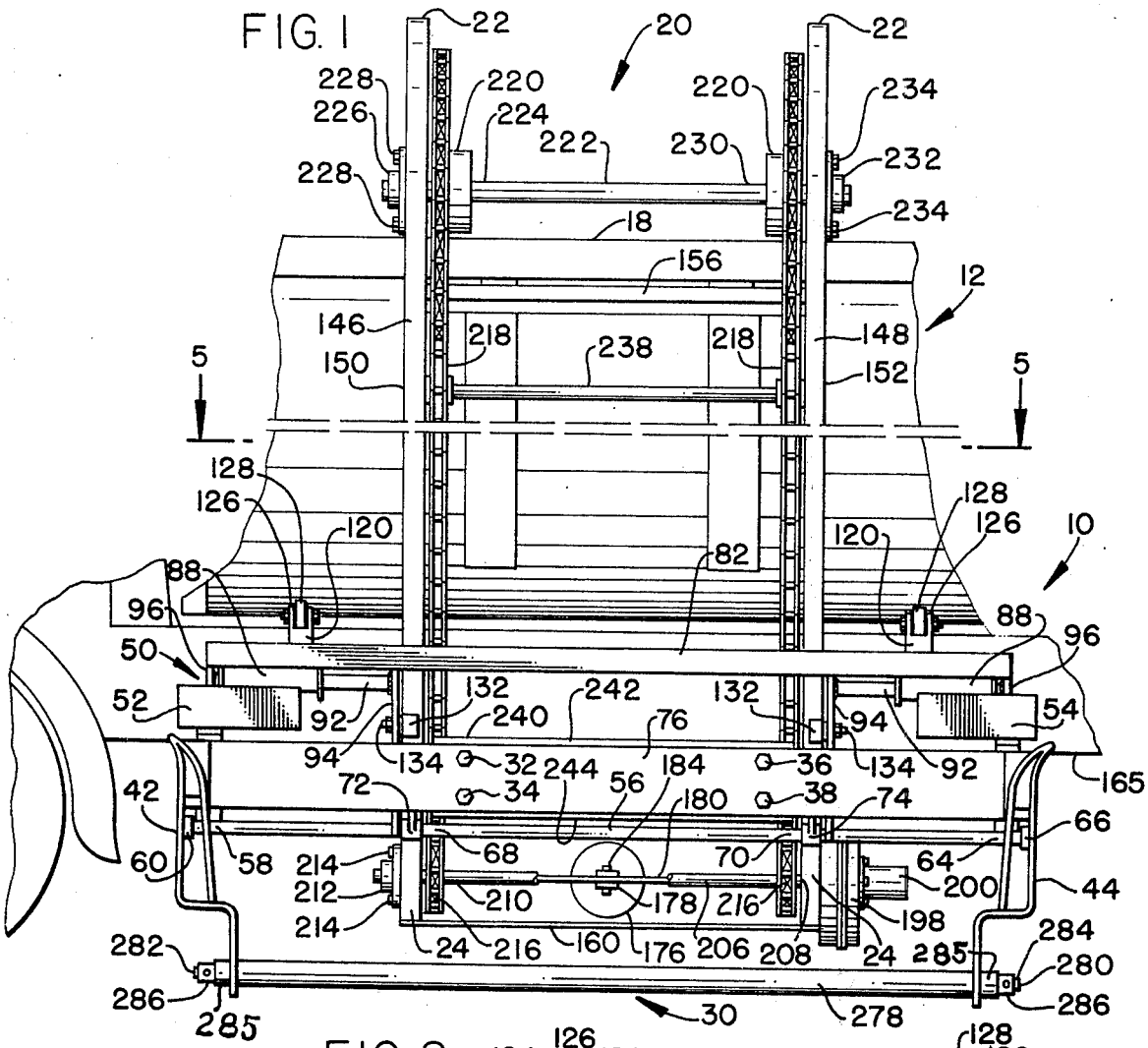
FIG. 1 is a front elevational view of a container emptying device of the present invention having portions thereof foreshortened for clarity and showing the device in position on the side of a vehicle shown in side elevation with portions broken away.
Figures 5, 6, 7, 8:
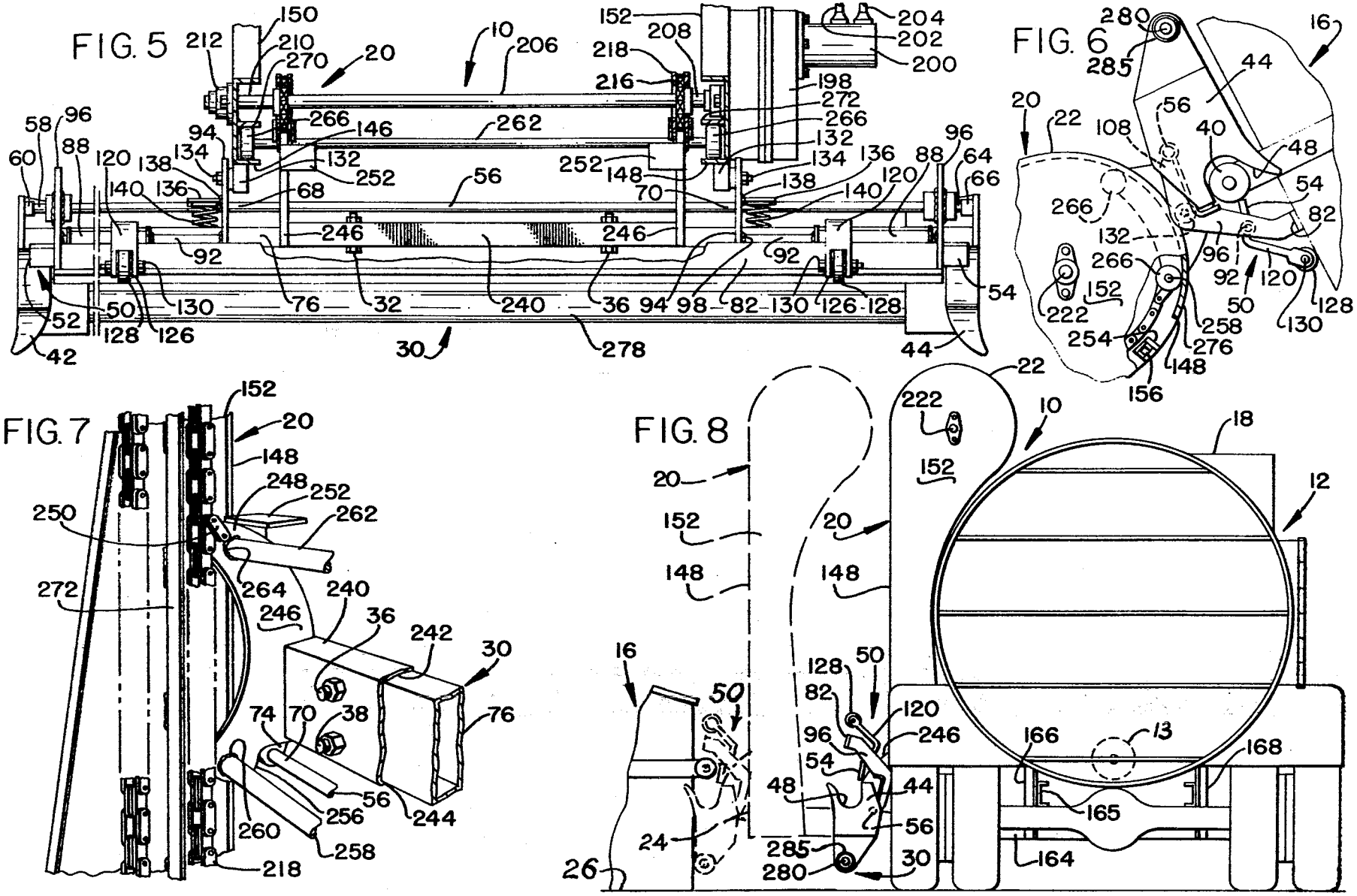
FIG. 5 is an enlarged, cross-sectional view taken along line 5—5 of FIG. 1.
FIG. 6 is an enlarged, partial side-elevational view showing a container connected to the device with the container in a tipped-dumping position.
FIG. 7 is an enlarged, partial perspective view of the device of FIG. 1 showing bolt means for connecting the container-engaging portion of the device to the elevator portion of the device.
FIG. 8 is a rear elevational view showing the device of FIG. 1 in position closely adjacent the truck of FIG. 1 in solid lines and in a laterally outward position in broken lines adjacent a partial elevational view of a container to be engaged by the device.
Figures 9, 10:
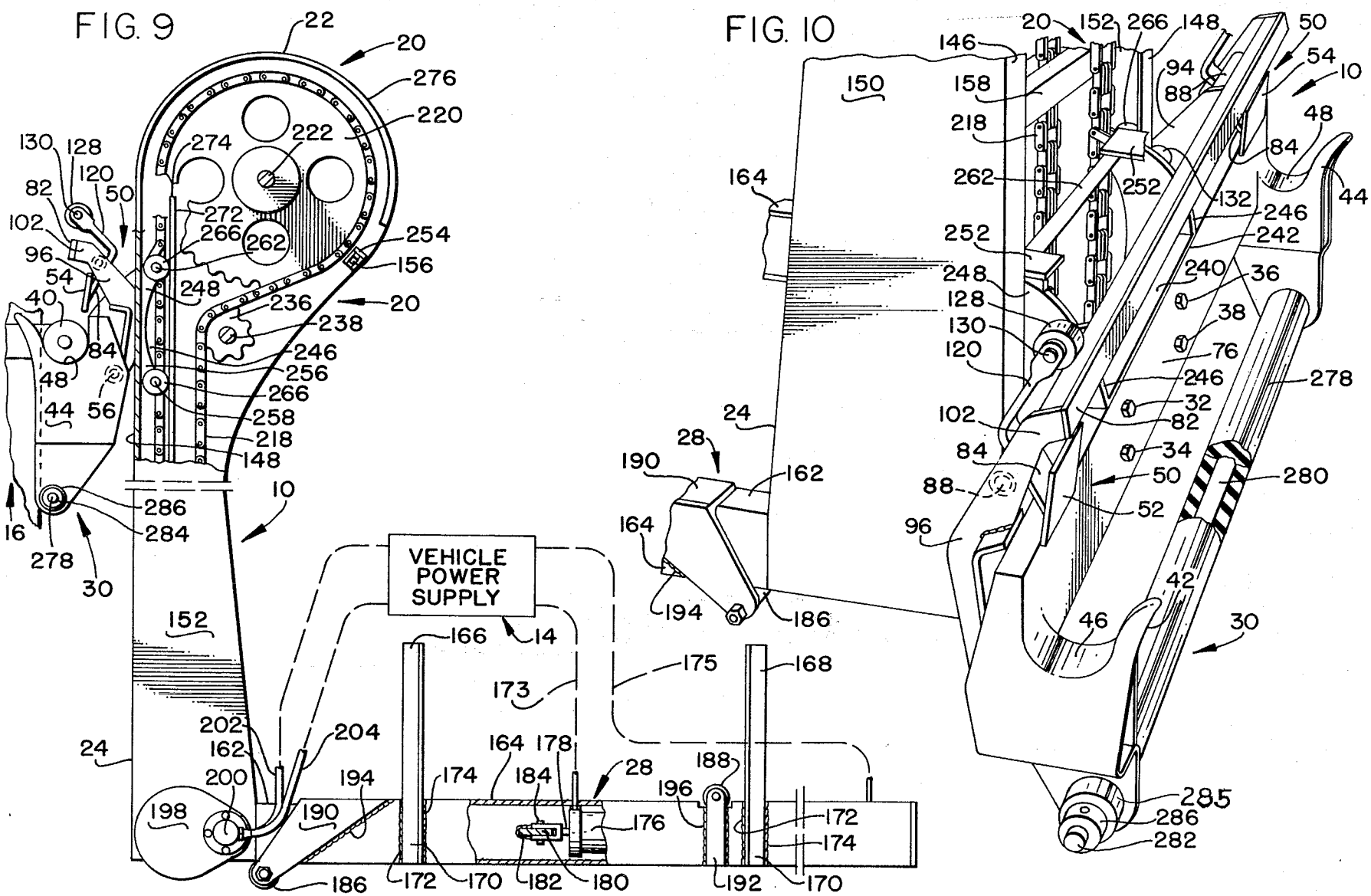
FIG. 9 is an enlarged elevational view, with parts broken away to show internal construction, of the device of FIG. 1 showing the device detached from the truck and showing the container-engaging portion of the device in engagement with a container.
FIG. 10 is an enlarged, partial perspective view showing the container-engaging portion of the device connected to the elevator portion of the device.

Referring again to the drawings, and more particularly to FIGS. 1 and 8, a container emptying device constituting a presently preferred embodiment of the invention, generally designated 10, is shown, for purposes of illustration, but not of limitation, in combination with a vehicle 12 having a suitable power supply, indicated schematically in FIG. 9 at 14 and fully illustrated and described in co-pending application, Ser. No. 410,405, filed Oct. 29, 1973, the disclosure of which is hereby incorporated herein by reference.

The container emptying device 10 is adapted to empty the contents of a trash container 16 (FIGS. 6, 8 and 9) into vehicle 12 through an elevated access opening 18 provided therein. Device 10 includes a suitable elevator means 20 for raising and lowering container 16 and including an upper end 22 adjacent access opening 18 and a lower end 24 adjacent a supporting surface 26 which supports container 16 laterally outwardly from vehicle 12.

Container emptying device 10 also includes a suitable connecting means, indicated generally at 28 in FIG. 9, for connecting the elevator means 20 to the vehicle power supply 14 for moving at least the lower end 24 of elevator means 20 over surface 26 between a first position closely adjacent vehicle 12, as shown in solid lines in FIG. 8, and a second position spaced laterally outwardly from vehicle 12 and closely adjacent container 16, as shown in broken lines in FIG. 8.

Device 10 also includes a container-engaging means 30 which may be quickly and easily connected to elevator means 20 by a plurality of bolts 32, 34, 36 and 38 facilitating interchanging container engaging means 30 with other container engaging means like, for example, the container engaging means shown in said co-pending application, Ser. No. 410,405. Container engaging means 30 is adapted to mechanically engage a suitable outwardly extending, transversely aligned abutment means which forms supporting means 40 provided on container 16 (FIGS. 6, 8 and 9) when the elevator means 20 is moved to the position shown in broken lines in FIG. 8 by power transmitted from vehicle power supply 14 to connecting means 28.

As best shown in FIGS. 2, 6, 8, 9 and 10, container-engaging means 30 includes a pair of hooks or U-shaped members 42, 44 having open-throat portions 46, 48, respectively, through which an associated one of the support abutment means 40, may pass when container engaging means 30 is elevated while in its FIG. 8 broken-line position. Container-engaging means 30 may then be moved inwardly to its FIG. 8 solid-line position by actuating vehicle power supply 14 to move the lower end 24 of elevator means to to its FIG. 8 solid-line position closely adjacent vehicle 12. Elevator means 20 may then be energized to raise container 16 to a position adjacent access opening 18 where suitable means, to be hereinafter described, will tip container 16 to the inverted position shown in FIG. 6. In this position, a suitable locking means 50 automatically locks the container to container engaging means 30 so that the support abutment means will not pass through open-throat U-shaped members 42, 44, as shown in FIG. 6. Locking means 50 includes a pair of lock bars 52, 54, adapted to bridge open-throat U-shaped members 42, 44, respectively. Lock bars 52, 54 are swingably connected to container-engaging means 30 by a shaft 56 having a first end 58 journaled in a hollow boss 60 affixed to U-shaped member 42 by a suitable weldment 62 (FIG. 3) and a second end journaled in a hollow boss 66 affixed to the U-shaped member 44. Shaft 56 includes first and second intermediate portions 68, 70 (FIG. 1) journaled in bearings 72, 74, respectively, rigidly affixed to a rectangular, tubular member or mounting bar 76 by brackets 246, respectively. Lock means 50 also includes a bumper bar 82 engageable by container 14 (FIG. 6) for swinging lock bars 52, 54 about shaft 56, upon movement of container 16 to the substantially inverted position shown in FIG. 6, whereby the lock bars 52, 54 will move into bridging positions in open-throat portions 46, 48.

Figure 4:
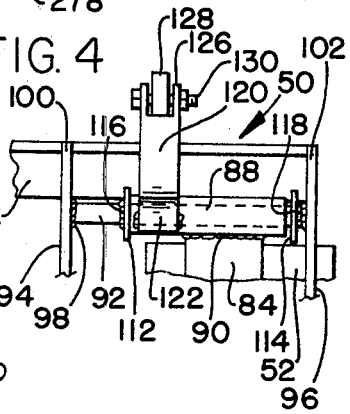
FIG. 4 is an enlarged, partial elevational view of the locking device portion shown in FIG. 2.

The lock bars 52, 54 are each affixed to a bracket 84 (FIG. 2) by a suitable weldment 86. Bracket 84 is secured to a sleeve 88 by a weldment 90 and sleeve 88 is rotatably mounted on a fixed shaft 92, which shaft, in turn, is rigidly affixed to a pair of arms 94, 96 by suitable weldments, like the one shown at 98 for arm 94. Arms 94, 96 have upper ends 100, 102 respectively, affixed to bumper bar 82 by suitable weldments, such as the one shown at 104 for arm 94, and lower ends 106, 108, respectively, affixed to shaft 56 by suitable weldments, like the one shown at 110 for arm 94. Longitudinal movement of sleeve 88 on shaft 92 is limited by a pair of thrust washers 112, 114 (FIG. 4) secured to the shaft 92 by weldments 116, 118, respectively. Each sleeve 88 carries an L-shaped arm 120 having a lower end 122 affixed to sleeve 88 by a weldment 124 and an upper, bifurcated end 126 having a roller 128 rotatably mounted thereon by a bolt 130. Rollers 128 are adapted to engage container 16 when it is inverted (FIG. 6) to prevent lock bars 52, 54 from swinging counterclockwise about shaft 92 due to the action of gravity. Rollers 128 have at least an elastomeric face thereon, and each roller forms an abutment to move lock bars 52, 54 across the respective open-throat portions 46, 48.

Figure 2:
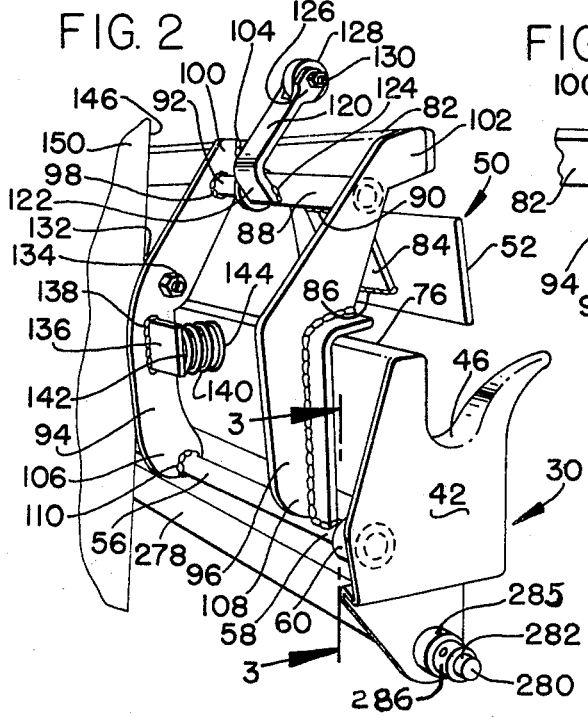
FIG. 2 is an enlarged, perspective view, showing a portion of the container-engaging and the locking portions of the device shown in FIG. 1.
Figure 3:
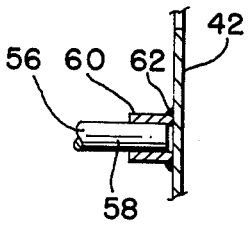
FIG. 3 is an enlarged, cross-sectional view taken along line 3—3 of FIG. 2.

Each arm 94 carries a cam roller 132, rotatably connected thereto by a bolt 134, and a bracket 136, affixed thereto by a weldment 138 (FIGS. 2 and 5). A compression spring 140 has a first end 142 bearing against bracket 136 and a second end 144 bearing against tubular member 76 for biasing cam rollers 132 into engagement with an associated one of the inturned flanges 146 provided on a pair of upstanding masts 150, 152, respectively, forming part of elevator means 20. Masts 150, 152, each includes upper end 22 and lower end 24 of elevator means 20 and are maintained in spaced-apart relationship by an upper transverse tubular brace 156 (FIGS. 1, 6 and 9), an intermediate brace 158 (FIG. 10) and a lower brace 160 (FIG. 1). Each lower end 24 is affixed to a rectangular tubular member 162 (FIGS. 9 and 10) reciprocably mounted in a channel 164 attached to the frame 164 (FIG. 8) of vehicle 12 by a pair of upstanding brackets 166, 168 (FIG. 9) each having a lower end 170 affixed to an associated one of the channels 164 by weldments 172, 174. Tubular member 162 is reciprocated by connecting means 28 which comprises an hydraulic cylinder 176 connected to vehicle power supply 14 by a pair of conduits 173, 175 and having a piston rod 178 connected to tubular member 162 by a transverse bar 180, affixed to tubular member 162 by a weldment 182, and a clevis pin 184. Reciprocating friction on tubular member 162 is minimized by a lower roller 186 and an upper roller 188 carried by brackets 190, 192, respectively, affixed to each channel 164 by weldments 194, 196, respectively.

A gear reduction unit 198 is mounted on lower end 24 of mast 152 for receiving the output from an hydraulic motor 200 receiving power from vehicle power supply 14 in the form of hydraulic fluid passing through conduits 202 and 204, as is described in detail in said co-pending application, Serial No. 410,405. As best seen in FIGS. 1 and 5, a driven shaft 206 has a first end 208 connected to gear reduction unit 198 and a second end 210 journalled in a bearing cup 212 affixed to the lower end 24 of mast 150 by bolts 214. The ends 208, 210 of shaft 206 each carries a sprocket 216 keyed thereto for driving an associated one of a pair of elevator chains 218 trained about an associated upper sprocket 220 keyed to a shaft 222 having a first end 224 journalled in a bearing cup 226 affixed to the upper end 22 of mast 150 by bolts 228 and a second end 230 journalled in a bearing cup 232 affixed to the upper end 22 of mast 148 by bolts 234. Each chain 218 is also trained around an idler sprocket 236 (FIG. 9) carried by a shaft 238 rotatably mounted on masts 150, 152.

Referring now to FIGS. 1, 5, 7, 9 and 10, elevator means 20 includes a channel 240 having flanges 242, 244 between which the rectangular tubular mounting bar 76 on container-engaging means 30 is mounted. An arcuate plate 246 is affixed to each end of channel 240 and includes an upper end 248 which is pivotally connected to elevator chain 218 by a link 250 (FIG. 7). An abutment plate 252 is rigidly affixed to the upper end 248 of each arcuate plate 246 for forming a stop to complimentally engage an elastomeric bumper 254 which is secured to the transverse tubular brace 156 and which prevents further downward movement of container 16 when it is in an inverted position adjacent access opening 18. Abutment plates 252 may be brought into engagement with bumper 254 repeatedly to jar the contents from container 16, if necessary. Each plate 246 also includes a lower end 256 to which and end of a shaft 258 is affixed by a weldment 260. A similar shaft 262 has the ends thereof affixed to the upper end 248 of each plate 246 by weldments, like that shown at 264 in FIG. 7. Each end of the shaft 258, 262 extends through its associated plate 246 where it rotatably receives a guide roller 266 adapted to ride in channel 268 formed by associated ones of the flanges 146, 148 and 270, 272 provided on the masts 150, 152, respectively, for guiding container engaging means 30 during its travel along the upright portions of masts 150, 152 to the upper ends of flanges 272. At this point, the inturned flanges 146, 148 each takes a 180 degree turn, as shown at 276 in FIG. 9 for the flange 148, so that guide rollers 266 will move container-engaging means 30 on a course which inverts container 16, as shown in FIG. 6. When container 16 moves over the arcs at the upper ends 222 of masts 150, 152, the container 16 will be supported by an elastomeric guide and support roller 278 encompassing a shaft 280 having a first end 282 extending through U-shaped member 42 and journaled in bearing 285, and a second end 184 extending through the U-shaped member 44 and journaled in a bearing 285. A set collar 286 may then be secured to each of the ends 282, 284.

OPERATION

Operation of the device will be readily understood. Assuming that the parts are in the positions shown in solid lines in FIG. 8, vehicle power supply 14 (FIG. 9) may be energized to supply fluid under pressure through conduit 175 to hydraulic cylinder 176 causing piston rod 178 to move container-engaging means 30 laterally outward from vehicle 12 over surface 26 to a position whereby the elastomeric guide and support roller 278 is moved into contact rolling relation with container 16 which will position the open-throat portions 46, 48 of the U-shaped members 42, 44 beneath support abutment means 40 on container 16, like the abutment means shown at 40 in FIG. 8, with the elastomeric guide and support rollers 278 being moved into contact relation with the container 16, as shown in dashed outline in FIG. 8. This will position the open-throat portions 46, 48 directly below the abutment support means 40, whereupon, by upward movement of the container engaging means 30, by elevator chains 218, the open-throat portions 46, 48 are guided into engagement with abutment support means 40, without the operator having to rely on manual skill to properly engage the container engaging means 30 with the container 16. The elastomeric roller minimizes the noise, and furthermore, it provides a friction surface to insure that the roller will roll upwardly along the side of the container 16 to cause proper engagement of the container engaging means 30 with the container 16.

The vehicle power supply 14 may then be controlled, as more fully explained in co-pending application, Serial No. 410,405, to discontinue flow of hydraulic fluid through conduit 175 to cylinder 176 and direct the fluid, under pressure, through conduit 204 (FIG. 9) to hydraulic motor 200 transmitting power through gear reduction unit 198 to shaft 206 (FIG. 1) causing container engaging means 30 to move upwardly in guided relation by elastomeric guide and support roller 278 into engagement with container 16 to lift the container slightly above surface 26. The flow of fluid through conduit 204 to hydraulic motor 200 may then be terminated and cylinder 176 may be pressurized by fluid flowing through conduit 173 to move container-engaging means 30 and container 16 inwardly to a position closely adjacent vehicle 12. The flow of hydraulic fluid to cylinder 176 may then be terminated and fluid may be directed through conduit 204 to hydraulic motor 200 to again elevate container-engaging means 30 and container 16. Guide roller 266 will guide container-engaging means 30 during the upward movement thereof. When guide rollers 266 enter the 180 degree turn 276, container 16 will be supported by elastomeric guide and support roller 276 until guide rollers 266 start down the other side of the 180° turn 276. Also the respective cam rollers 132 will engage the outer side of the respective flanges 146, 148, simultaneously with the cam rollers 132 entering onto the respective 180 degree turns 276, will cause a change of distance between the guide rollers 266, and the cam rollers will move the arms 94, 96 outward, due to the change in distance between the cam rollers 132 and the guide rollers 266. This movement will pivot locking means 50 (including arms 94, 96) about the axis of shaft 56 to urge rollers 128 against the side of the container 16 to move bumper bar 82 into contact with container 16. Upon rollers 128 engaging container 16, simultaneously with the cam rollers entering onto the respective 180 degree turns 276, will cause the pivoting of sleeves 88, the pair of arms 84 and the L-shaped arms 120 to pivot about the axis of shafts 92 to move the lock bars 52, 54 in biased relation into open-throat portions 46, 48 respectively of U-shaped members 42, 44 to retain support abutment means therein. The double pivot action of shaft 56 and sleeve 88 is effective to impart sufficient movement to lock bars 52, 54 to move the lock bars into biased relation in U-shaped members 42, 44 to retain support abutment means 40 in open-throat portions 46, 48 respectively, to automatically lock container-engaging means 30.

Container engaging means 30 will continue its downward movement until abutment plates 252 engage elastomeric bumper 254, whereupon, the contents from container 16 should have passed through access opening 18. If necessary, however, the flow of fluid to hydraulic motor 200 may be reversed briefly moving abutment plates 252 away from the elastomeric bumper 254 a shoft distance, whereupon, the flow of fluid to motor 200 may again be reversed causing plates 252 to re-engage bumper 254 for jarring the contents from container 16. Motor 200 may again be reversed so that elevator chains 218 will carry container-engaging means 30 and container 16 back up around turn 276 and back down the upright portions of masts 150, 152 to the position shown in solid lines in FIG. 8, whereupon motor 200 may be de-energized while container 16 is still slightly above surface 25. Hydraulic cylinder 176 may then again be energized to move masts 150, 152 to the position shown in FIG. 8 in broken lines, whereupon, motor 200 may be energized to lower container 16 to surface 26.

While the particular container emptying device herein shown and described in detail is fully capable of attaining the objects and providing the advantages hereinbefore stated, it is to be understood that it is merely illustrative of the presently preferred embodiment of the invention, and that no limitations are intended to the details of construction or design herein shown, other than as defined in the appended claims, which form a part of this disclosure. However, the term "means" is employed in these claims is to be interpreted as defining the corresponding structure illustrated and described in this specification or the equivalent of the same.

The bumper bar 82 is preferably faced on at least one face thereof with an elastomeric material so as to minimize noise, when the bumper bar is moved against container 16.

The body of the vehicle 12 has a hydraulic cylinder-plunger assembly 13 extending longitudinally of the body so as to eject refuse from the body, when desired, in a manner similar to that set out in the aforementioned co-pending application.

What is claimed is:

1. In combination with a vehicle having a power supply means and an elevated access opening, apparatus for emptying the contents of a refuse container into the vehicle through the elevated access opening, which apparatus comprises:

a. a refuse container having axially aligned support abutment means provided thereon transversely thereof, b. elevator means including an endless carrier for raising and lowering said container,

1. said elevator means having an upper end adjacent said elevated access opening and a lower end adjacent a surface supporting said container, c. means connecting said elevator means to said power supply means to move at least said lower end of said elevator means over said surface between a first position closely adjacent said vehicle and a second position spaced outwardly from said vehicle and closely adjacent said container, d. container-engaging means connected to said endless carrier, whereby said container engaging means is inverted upon guided movement along a curved portion of said upper end of said elevator means, said container engaging means mechanically engaging the support abutment means on said container when said elevator means is moved to said second position by said power supply means, said container-engaging means including a U-shaped member having an open throat, and locking means for automatically locking said support abutment means to said container engaging means so that said container will remain in connected relationship with said container-engaging means when said container is tipped toward said elevated access opening to empty said container, said locking means including,

1. lock bar means for bridging said open throat, when in one position,

2. shaft means swingably connecting said lock bar means to said container engaging means, and

3. abutment means engageable by said container for swinging said lock bar means about the axis of said shaft means upon movement of said container to said tipped position, whereby said lock bar means will move to said bridging position.

2. An apparatus for emptying a refuse container as defined in claim 1; including a. means to releasably connect said container-engaging means to said elevator means, whereby said container-engaging means may be quickly and easily installed on, and removed from said vehicle.

3. An apparatus for emptying a refuse container as defined in claim 1; wherein said elevator means comprises a. first and second mast means, each having an upper end and a lower end,

1. guide track means extending from each lower end of said respective mast means to each respective upper ends thereof,

2. each said guide track means including an arcuate turn portion at the upper end of the mast means associated therewith, b. first sprocket means rotatably mounted on said respective mast means, near the upper ends thereof, c. second sprocket means rotatably mounted on said respective mast means, near the lower ends thereof, d. drive shaft means connecting one set of said sprocket means together, e. driven shaft means connecting the other set of said sprockets together, f. conveyor chain means trained about said first and second sprocket means on each said mast means, g. arcuate plate means pivotally connected to each of said chain means,

1. each said arcuate plate means having an upper end and a lower end, h. guide roller means rotatably mounted on each of said ends of each of said arcuate plate means,

1. said guide roller means being mounted in said guide track means for guiding said arcuate plate means along said mast means and around said arcuate turn portions to substantially inverted positions, i. channel means having the ends thereof rigidly connected to said arcuate plate means, j. an elongated member affixed to the lower end of each said mast means to maintain said mast means upright in spaced apart positions,

1. said means for connecting said elevator means to said power supply means being connected to said elongated member to reciprocate said elongated member, k. motor means connected to said drive shaft means to drive said conveyor chain means.

4. An apparatus for emptying a refuse container, as defined in claim 3; wherein said container-engaging means comprises:

a. mounting bar means,

1. bolt means for quickly and easily connecting said mounting bar means to said channel means on said arcuate plate means.

5. In combination with a vehicle having a power supply means and an elevated access opening, an apparatus for emptying the contents of a refuse container into the vehicle through the elevated opening, as defined in claim 1; wherein a. said container-engaging means has the open throat of the U-shaped members facing upwardly, b. a roller mounted on said container-engaging means a spaced distance below said open throat, U-shaped members, and having the roller in vertical alignment with the open throats of the U-shaped members so upon engagement of the roller with the container, the open throat, U-shaped members will be guided upwardly to receive the axially aligned support abutments therein.

6. An apparatus as defined in claim 5; wherein a. said roller mounted on said container-engaging means has at least the surface thereof covered with an elastomeric material.

* * * * *